US008434849B2

(12) United States Patent
Kurasawa et al.

(10) Patent No.: US 8,434,849 B2
(45) Date of Patent: May 7, 2013

(54) PRINTING APPARATUS TO DRY SHEETS ON WHICH INK IS APPLIED

(75) Inventors: Kanto Kurasawa, Kawasaki (JP); Yoshiaki Suzuki, Nagareyama (JP); Toshihide Wada, Yokohama (JP); Toshiaki Tokisawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 204 days.

(21) Appl. No.: 12/961,977

(22) Filed: Dec. 7, 2010

(65) Prior Publication Data

US 2011/0261102 A1 Oct. 27, 2011

(30) Foreign Application Priority Data

Apr. 22, 2010 (JP) ..... 2010-099148

(51) Int. Cl.
*B41J 29/38* (2006.01)

(52) U.S. Cl.
USPC ..... 347/16

(58) Field of Classification Search ..... None
See application file for complete search history.

(56) References Cited

U.S. PATENT DOCUMENTS

2005/0253912 A1* 11/2005 Smith et al. ..... 347/102
2010/0192792 A1* 8/2010 Hall et al. ..... 101/424.1
2011/0064507 A1* 3/2011 McLaughlin ..... 400/612

FOREIGN PATENT DOCUMENTS

JP 2001-71474 A 3/2001
JP 2002-361850 A 12/2002
JP 2002361850 A * 12/2002

* cited by examiner

*Primary Examiner* — Geoffrey Mruk
*Assistant Examiner* — Bradley Thies
(74) *Attorney, Agent, or Firm* — Canon USA, Inc., IP Division

(57) ABSTRACT

An apparatus includes a printing unit and a drying unit. The printing unit performs printing on a sheet using ink. The drying unit dries the sheet on which the ink is applied at the printing unit as the sheet is conveyed in the drying unit. The drying unit causes hot air heated by a heater to circulate through a housing and blows the hot air to the sheet. The housing includes an opening through which movement of gas between inside and outside the housing can be adjusted. When conveyance of the sheet in the drying unit stops, the apparatus is controlled to reduce an output of the heater and to increase the movement of the gas through the opening.

14 Claims, 9 Drawing Sheets

PRINTING APPARATUS TO DRY SHEETS ON WHICH INK IS APPLIED

BACKGROUND OF THE INVENTION

1. Field of the Invention

The present invention relates to a printing apparatus which makes prints with ink.

2. Description of the Related Art

Printing apparatus ink typically is dried at some point in the printing process to avoid streaking or "offsetting," in which wet ink smears or transfers from one sheet to an adjacent sheet. Japanese Patent Laid-Open No. 2001-71474 discloses an inkjet image forming apparatus provided with a drying unit (i.e., a drying and fixing unit) for drying ink. In the drying unit, heated air is blown onto a sheet surface by an air blowing unit constituted by a heater and a fan. The blown air is collected in an air collecting chamber and is made to recirculate to the air blowing unit.

In the apparatus disclosed in Japanese Patent Laid-Open No. 2001-71474, air is made to circulate through a substantially closed space in the drying unit. When such an apparatus is used for long time continuous printing or high-duty printing with heavy ink consumption, the ink evaporates and generates steam, which stays in a circulation flow path. Thus, humidity in the air in the circulation flow path gradually increases. As humidity increases, dew-point temperature is raised. When sheet temperature is at or below the dew point, condensation occurs on a sheet surface, whereby the sheet becomes harder to dry and moisture content in the sheet increases. Thus, efficiency in drying the sheet decreases.

In addition, when the printing apparatus jams and conveyance of a sheet is stopped in a printing process, an operator should perform an unjamming operation by removing the sheet from the drying unit. However, workability of the operator in such an unjamming operation is not considered in the apparatus disclosed in Japanese Patent Laid-Open No. 2001-71474.

SUMMARY OF THE INVENTION

An apparatus according to the present invention includes a printing unit and a drying unit. The printing unit performs printing on a sheet using ink. The drying unit dries the sheet on which the ink is applied at the printing unit as the sheet is conveyed in the drying unit. The drying unit causes hot air heated by a heater to circulate through a housing and blows the hot air to the sheet. The housing includes an opening through which movement of gas between inside and outside the housing can be adjusted. When conveyance of the sheet in the drying unit stops, the apparatus is controlled to reduce an output of the heater and to increase the movement of the gas through the opening.

Further features of the present invention will become apparent from the following description of exemplary embodiments with reference to the attached drawings.

DESCRIPTION OF THE EMBODIMENTS

One of the aspects of embodiments provides a printing apparatus that includes a drying unit that keeps high drying efficiency even after a long time continuous operation and has high energy utilization efficiency. One of the aspects of embodiments also provides a printing apparatus with excellent maintenance workability. With the printing apparatus, an operator can perform an unjamming operation promptly and properly when conveyance of a sheet is stopped due to, for example, a sheet jam in a drying unit.

According to the printing apparatus of the present embodiment, high drying efficiency can be kept even after a long time continuous operation and energy utilization efficiency is high. The printing apparatus of the present invention has excellent maintenance workability. An operator can perform an unjamming operation promptly and properly when conveyance of a sheet is stopped due to, for example, a sheet jam in a drying unit.

Figure 6B:
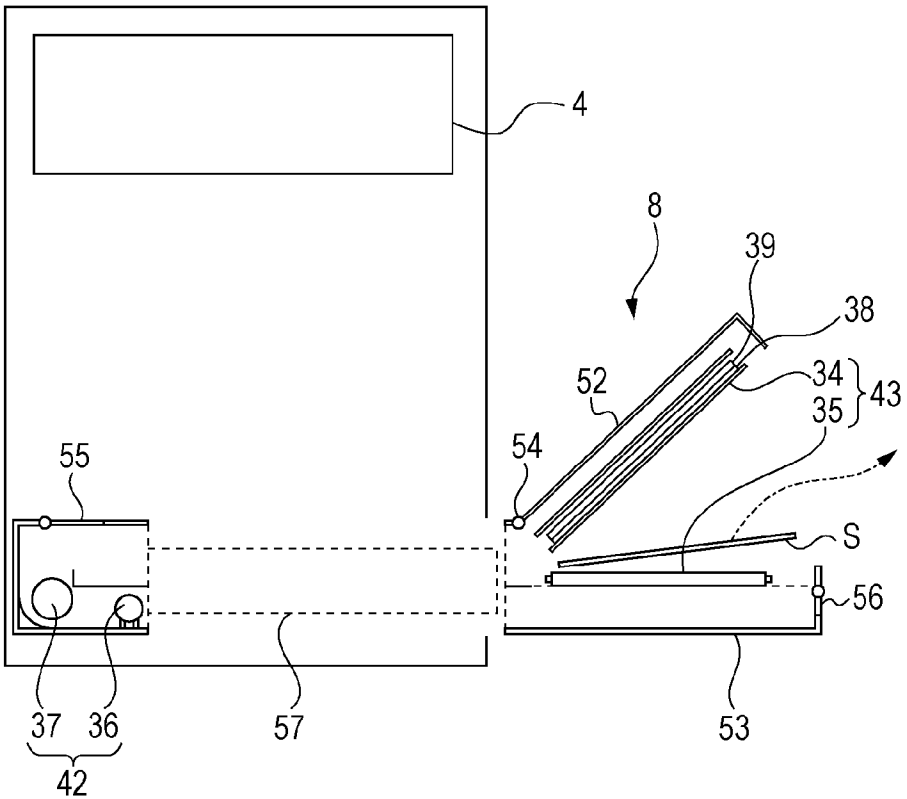
FIG. 6B is a sectional view of a main body of the printing apparatus.
Figure 6A:
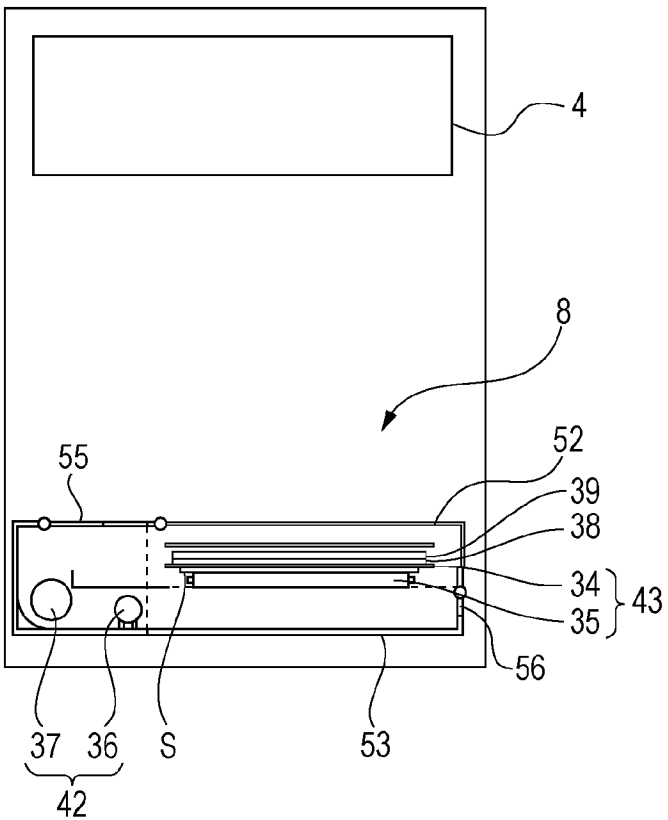
FIG. 6A is a sectional view of a main body of the printing apparatus.

FIG. 6A is a sectional view of a main body of the printing apparatus. Hereinafter, an embodiment of an inkjet printing apparatus will be described. The printing apparatus according to the present embodiment is a high-speed line printing apparatus switchable between simplex and duplex printing modes. A unit of printing is referred to as one page, a page, one unit image, or a unit image and an elongated continuous sheet is longer than repeated units of printing in the conveying direction of the sheet. An elongated continuous sheet is used in the printing apparatus. For example, the printing apparatus is suitable for printing a large number of sheets in a printing laboratory. When a plurality of small images, text and space are included in one unit of printing (i.e., one page), those included in the unit of printing are collectively referred to as one unit image herein. That is, the unit image is one unit of printing (i.e., one page) in a process of sequentially printing a plurality of pages on a continuous sheet. The length of the unit image varies depending on the sizes of images to be printed. For example, the length of a 127 mm-long and 89 mm-wide photograph is 135 mm in the conveying direction and the length of a DIN A4-sized sheet is 297 mm.

The present invention is widely applicable to printing apparatuses, such as a printer, a printer multi-functional peripheral, a copier, a facsimile machine and apparatuses for manufacturing various devices. Any printing system may be selected, including an inkjet printing system, an electrophotography printing system, a heat transfer printing system, a dot impact printing system and a liquid development printing system. The present invention is also applicable to other sheet processing devices which perform various processes that require drying of a continuous sheet (e.g., recording, processing, application, irradiation, reading and inspection).

Figure 1:
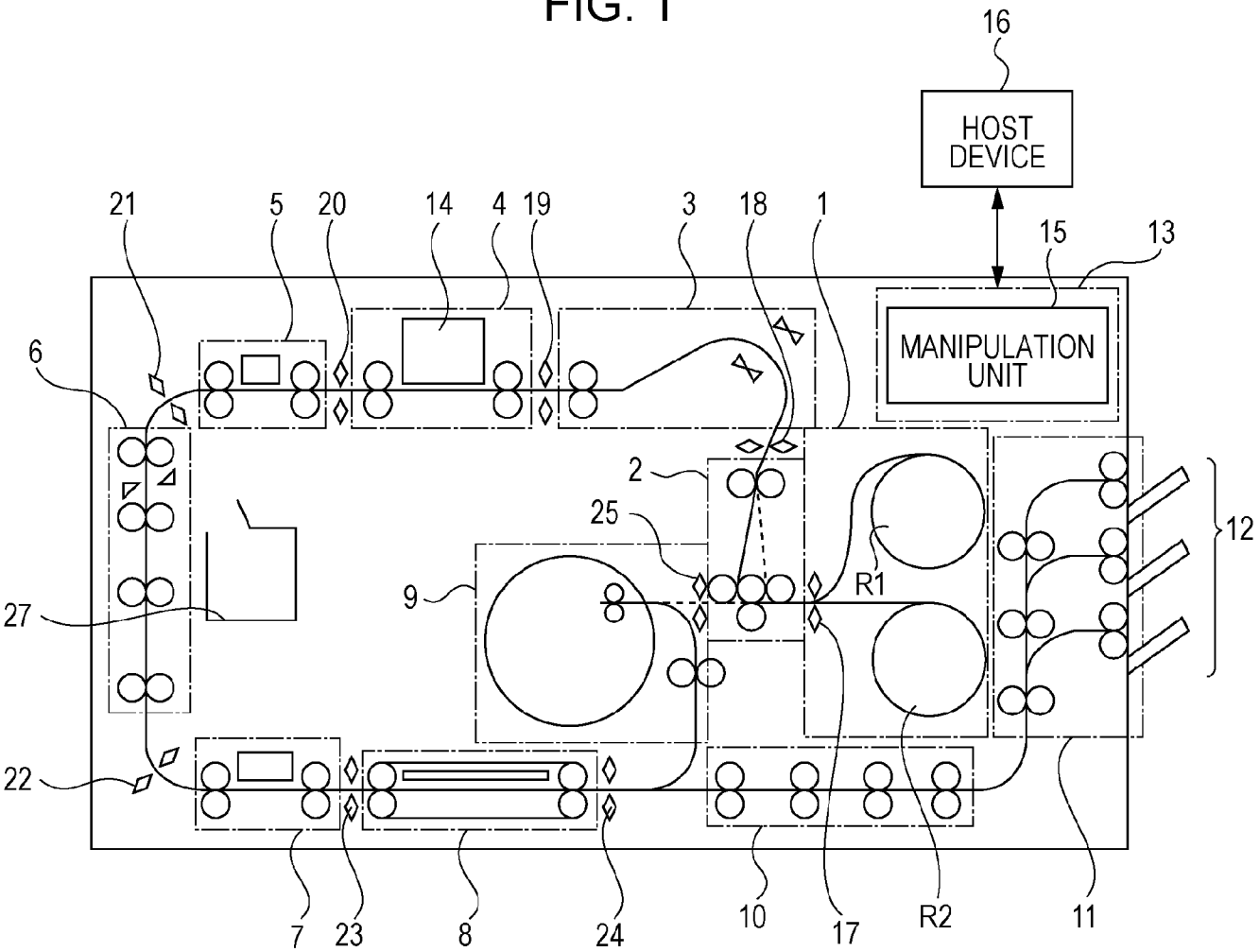
FIG. 1 is a schematic diagram of an internal configuration of a printing apparatus.

FIG. 1 is a schematic sectional view of an internal configuration of a printing apparatus. The printing apparatus of the present embodiment is capable of printing on a first surface and a second surface positioned opposite to the first surface of a rolled-up sheet. The printing apparatus mainly includes therein a sheet feeding unit 1, a decurling unit 2, an skew correcting unit 3, a printing unit 4, an inspection unit 5, a cutting unit 6, an information recording unit 7, a drying unit 8, a reverse unit 9, a discharge conveying unit 10, a sorting unit 11, a discharge unit 12, and a control unit 13. A sheet is conveyed along a sheet conveyance path illustrated as a solid line in FIG. 1 by a conveyance mechanism, which consists of a pair of rollers or a belt, and is processed in each of the units. The sheet is conveyed downstream along the sheet conveyance path while printing. At an arbitrary position in the sheet conveyance path where the sheet is conveyed from feeding means to discharging means, a side toward the feeding means is referred to as "the upstream side", and the opposite side toward the discharging means is referred to as "the downstream side".

The sheet feeding unit 1 supports and feeds a rolled-up continuous sheet. The sheet feeding unit 1 can accommodate rolls R1 and R2, one of which is selectively drawn and supplied. The number of rolls in not limited to two and one or three or more rolls may be accommodated. As long as it is continuous, the sheet is not necessarily rolled up. For example, a continuous sheet with perforations formed for each unit length may be folded at the perforations and stacked in the sheet feeding unit 1.

The decurling unit 2 reduces the curling (i.e., warping) of the sheet fed from the sheet feeding unit 1. In the decurling unit 2, the curling is reduced by applying decurling force to the curled sheet which is made to pass through two pairs of pinch rollers driven by a single driving roller such that the sheet might be curled in an opposite direction.

The skew correcting unit 3 corrects an skew (i.e., an inclination to a direction in which the sheet should travel) of the sheet which has passed through the decurling unit 2. The skew of the sheet is corrected by forcing a reference end of the sheet on a guide member.

While the sheet is being conveyed, the printing unit 4 makes printing on the sheet from above by print heads 14 and forms an image. The printing unit 4 also includes a plurality of conveying rollers which convey the sheet. Each of the print heads 14 is a linear printing head constituted by an array of inkjet nozzles disposed over the maximum width of a sheet expected to be used. A plurality of print heads 14 are arranged in parallel along the conveyance direction. In the present embodiment, seven print heads are provided for seven colors of cyan (C), magenta (M), yellow (Y), light cyan (LY), light magenta (LM), gray (G) and black (K). The numbers of the colors and the print heads are not limited to seven. The inkjet printing system may be, for example, a thermal inkjet printing system, a piezoelectric inkjet printing system, an electrostatic inkjet printing system and a MEMS inkjet printing system. Each of the colored ink is supplied to each print head 14 via an ink tube from an ink tank.

The inspection unit 5 optically reads, with a scanner, an inspection pattern and an image printed on the sheet in the printing unit 4, inspects, for example, a state of the nozzles of the print heads, a state of conveyance of the sheet and image positions and determines whether the image has been printed correctly. The scanner includes a CCD image sensor or a CMOS image sensor.

The cutting unit 6 includes a mechanical auto cutter which cuts the sheet after the printing to predetermined lengths. The cutting unit 6 also includes a plurality of conveying rollers which sends the sheet to subsequent next processes after the cutting.

The information recording unit 7 records print information (inherent information), such as a serial number and a printed date, on a non printed area of the cut sheet. Texts or codes are recorded by inkjet printing or heat transfer printing.

The drying unit 8 heats the sheet with an image formed thereon in the printing unit 4 and dries the applied ink in a short time. As the sheet passes through the drying unit 8, hot air is blown at least from below on the sheet and an ink-applied surface is dried.

The sheet conveyance path from the sheet feeding unit 1 to the drying unit 8 described above will be referred to as a first path. The first path turns around between the printing unit 4 and the drying unit 8. The cutting unit 6 is provided in the middle of the turning around portion.

The reverse unit 9 temporarily takes up the continuous sheet which has completed the printing on the front surface thereof and reverses the sheet for duplex printing. The reverse unit 9 is provided in the middle of a path established from the drying unit 8 to the printing unit 4 via the decurling unit 2 (i.e., a loop path; hereinafter, referred to as a "second path") such that the sheet which passed through the drying unit 8 might be fed to the printing unit 4 again. The reverse unit 9 includes a winding rotary member (i.e., a drum) which rotates to winding the sheet. The continuous sheet which is still uncut after the printing on the front surface is temporarily taken up on the winding rotary member. After the sheet is taken up, the winding rotary member rotates in an opposite direction and the taken up sheet is fed to the decurling unit 2 and sent to the printing unit 4. Since the sheet has been reversed, printing can be made on a back surface of the sheet in the printing unit 4. Detailed description of the operation of the duplex printing will be given later.

The discharge conveying unit 10 conveys the sheet to the sorting unit 11 after the sheet is cut in the cutting unit 6 and dried in the drying unit 8. The discharge conveying unit 10 is provided in a path different from the second path on which the reverse unit 9 is provided (hereinafter, referred to as a "third path"). A path switching mechanism with a movable flapper is provided in a branching position of the paths for a selective guide of the sheet conveyed on the first path to either one of the second or third path.

The sorting unit 11 and the discharge unit 12 are provided at a side of the sheet feeding unit 1 and at an end of the third path. The sorting unit 11 sorts the printed sheet into groups as necessary. The sorted sheet is discharged to the discharge unit 12 which consists of a plurality of trays. As described above, the sheet is discharged along the third path which is disposed below the sheet feeding unit 1 and at a side of the sheet feeding unit 1 opposite to the printing unit 4 and the drying unit 8.

The decurling unit 2, the skew correcting unit 3, the printing unit 4, the inspection unit 5, the cutting unit 6, the information recording unit 7, the drying unit 8, the reverse unit 9 and the discharge conveying unit 10 are independent process units. In order to simplify the maintenance operation, such as an unjamming operation, the operator can manually draw an arbitrary unit independently from the main body of the printing apparatus.

Each of these units is provided with cutters for cutting the continuous sheet. The cutters are each provided in the upstream and the downstream of the sheet conveyance path near each of the units. The operator can use the cutter to cut the sheet near the upstream or downstream of the unit to be drawn for the unjamming operation, whereby the unit can be drawn easily. The cutters are hand cutters operated manually by the operator. The cutters are operated by hand of the operator or driven by an actuator in accordance with an instruction from the operator. As illustrated in FIG. 1, nine hand cutters of first cutter 17 to ninth cutter 25 are provided at nine places along the sheet conveyance path in the printing apparatus. The first cutter 17 is provided between the sheet feeding unit 1 and the decurling unit 2. Similarly, the second cutter 18 is provided between the decurling unit 2 and the skew correcting unit 3, the third cutter 19 is provided between the skew correcting unit 3 and the printing unit 4, the fourth cutter 20 is provided between the printing unit 4 and the inspection unit 5 and the fifth cutter 21 is provided between the inspection unit 5 and the cutting unit 6. In the downstream of the cutting unit 6, the sixth cutter 22 is provided between the cutting unit 6 and the information recording unit 7, the seventh cutter 23 is provided between the information recording unit 7 and the drying unit 8 and the eighth cutter 24 is provided near and in the downstream of the drying unit 8. The ninth cutter 25 is provided between the reverse unit 9 and the decurling unit 2. It is not necessary to provide a cutter for cutting the continuous sheet in the downstream of the discharge conveying unit 10 since no continuous sheet is conveyed there.

The control unit 13 manages the control of each component of the entire printing apparatus. The control unit 13 includes a CPU, a storage device, a control unit (i.e., a control unit) provided with various control units, an external interface and a manipulation unit 15 for the user input and output. The operation of the printing apparatus is controlled in accordance with instructions from a host device 16, such as a control unit or a host computer connected to the control unit via an external interface.

Figure 2:
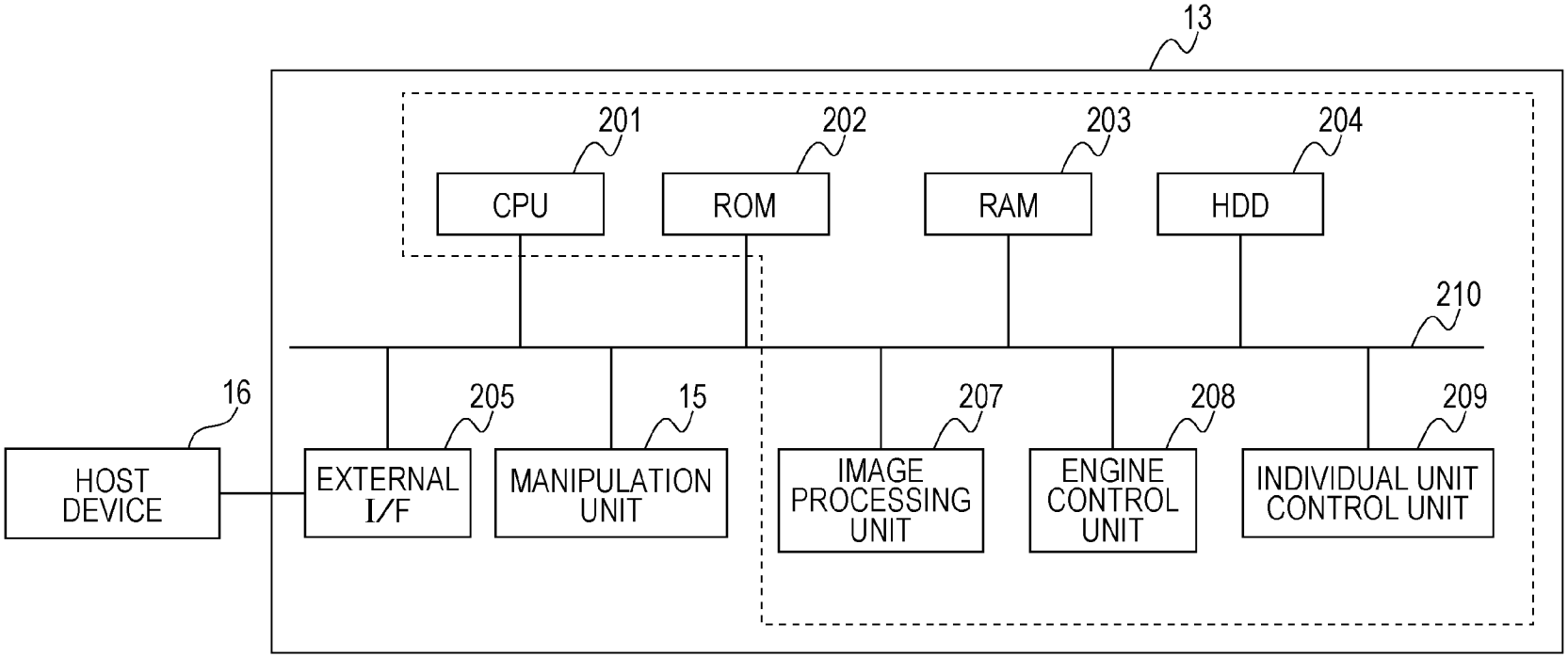
FIG. 2 is a block diagram of a control unit.

FIG. 2 is a block diagram illustrating a concept of the control unit 13. The control unit (a range surrounded by a dashed line) included in control unit 13 is constituted by a central processing unit (CPU) 201, a ROM 202, a RAM 203, a hard disk drive (HDD) 204, an image processing unit 207, an engine control unit 208 and an individual unit control unit 209. The CPU 201 collectively controls the operation of each unit of the printing apparatus. The ROM 202 stores programs to be implemented by the CPU 201 and fixed data necessary for various operations of the printing apparatus. The RAM 203 is used as a work area of the CPU 201, as a temporary storing region of various types of received data or as storage for various types of setting data. The HDD 204 is capable of storing programs to be implemented by the CPU 201, print data and setting information required for various operations of the printing apparatus. The manipulation unit 15 is a user I/O interface. The manipulation unit 15 includes an input section consisting of a hard key and a touch panel, and an output section consisting of a display device on which information is displayed and a sound generator. For example, the manipulation unit 15 may be a display device with a touch panel on which an operation status, printing status, maintenance information (e.g., a remaining amount of ink, a remaining amount of the sheets and a maintenance status) of the apparatus are displayed to a user. The user can input various types of information through the touch panel.

A dedicated processing section is provided for units that require high-speed data processing. The image processing unit 207 performs image processing of the print data processed in the printing apparatus. A color space (e.g., YCbCr) of the input image data is converted into a standard RGB color space (e.g., sRGB). Various image processing, such as resolution conversion, image analysis and image correction, is performed as necessary to the image data. The print data obtained through the image processing is stored in the RAM 203 or the HDD 204. The engine control unit 208 controls driving of the print head 14 of the printing unit 4 in accordance with the print data on the basis of the control commands received from, for example, the CPU 201. The engine control unit 208 also controls the conveyance mechanism of each component of the printing apparatus. The individual unit control unit 209 is a sub control unit which individually controls the sheet feeding unit 1, the decurling unit 2, the skew correcting unit 3, the inspection unit 5, the cutting unit 6, information recording unit 7, the drying unit 8, the reverse unit 9, the discharge conveying unit 10, the sorting unit 11 and the discharge unit 12. The individual unit control unit 209 controls the operation of each unit in accordance with the instructions from the CPU 201. The external interface 205 is a local I/F or a network I/F provided for connecting the control unit to the host device 16. The components described above are connected by system bus 210.

The host device 16 is a source of supply of image data to be printed on the printing apparatus. The host device 16 may be a general purpose computer or a dedicated computer, or may be dedicated image equipment, such as, a digital camera, a photograph storage device and an image capturer with an image reader. If the host device 16 is a computer, an OS, application software for generating the image data and a printing device driver for the printing apparatus are installed in a storage device of the computer. It is not necessary to implement all of these processes by software, but a part or all of them may be implemented by hardware.

Next, a basic operation for the printing will be described. The simplex printing mode and the duplex printing mode have different print operations, which will be described separately.

In the simplex printing mode, printing is made in the printing unit 4 on the front surface (i.e., the first surface) of the sheet which is fed from the sheet feeding unit 1 and processed in the decurling unit 2 and the skew correcting unit 3. Images of the predetermined unit length in the conveyance direction (i.e., unit images) are printed sequentially on the elongated continuous sheet and a plurality of images are formed and arranged. The printed sheet is made to pass through the inspection unit 5 and is cut for each unit image in the cutting unit 6. Print information is given on the back surface of the cut sheet as necessary in the information recording unit 7. The cut sheet is then conveyed to the drying unit 8 one at a time and is dried. The sheet is then conveyed via the discharge conveying unit 10 and is sequentially discharged and stacked in the discharge unit 12 of the sorting unit 11. The sheet left in the printing unit 4 after the last unit image is cut is made to return to the sheet feeding unit 1 and is taken up on the roll R1 or R2. In this manner, in the simplex printing mode, the sheet is conveyed along the first path and the third path for the processing and is not conveyed along the second path.

In the duplex printing mode, after a print sequence for the front surface (i.e., the first surface) is completed, a print sequence for the back surface (i.e., the second surface) is performed. First, in the print sequence for the front surface, the sheet feeding unit 1 to the inspection unit 5 each operate in the same manner as in the above-described simplex printing mode. The sheet is not cut in the cutting unit 6 and is conveyed as the continuous sheet to the drying unit 8. After the ink on the front surface is dried in the drying unit 8, the sheet is guided not to the path at the side of the discharge conveying unit 10 (i.e., the third path) but to the path at the side of the reverse unit 9 (i.e., the second path). The sheet is wound by the winding rotary member of the reverse unit 9 which is rotating in a forward direction (i.e., the counterclockwise direction in the drawing) in the second path. When all the scheduled printing on the front surface is completed in the printing unit 4, a trailing end of the printing area of the continuous sheet is cut in the cutting unit 6. The continuous sheet in the downstream of the conveyance direction (i.e., the printed side) from the cut position is completely taken up to the trailing end (i.e., the cut position) of the sheet in the reverse unit 9 via the drying unit 8. At the same time with the winding operation in the reverse unit 9, the continuous sheet left at the upstream side (i.e., the side of the printing unit 4) from the cut position in the conveyance direction is returned to the sheet feeding unit 1 and wound on the roll R1 or R2 such that the leading end of the sheet (i.e., the cut position) might not be left in the decurling unit 2. Such a back feeding system avoids collision with a sheet which is fed again for the subsequent print sequence for the back surface.

After the above-described print sequence for the front surface is completed, the print sequence for the back surface is started. The winding rotary member of the reverse unit 9 rotates in a reverse direction of the winding direction (i.e., a clockwise direction in the drawing). An end of the wound sheet (the trailing end of the sheet at the time of winding becomes the leading end of the sheet at the time of sending out) is sent to the decurling unit 2 along the path of the dashed line in FIG. 1. The decurling unit 2 corrects the curling given by the winding rotary member. The decurling unit 2 is provided between the sheet feeding unit 1 and the printing unit 4 in the first path and is provided between the reverse unit 9 and the printing unit 4 in the second path. Thus, the decurling unit 2 is commonly used for decurling in both the paths. The reversed sheet is sent to the printing unit 4 via the skew correcting unit 3, and printing is made on the back surface thereof. The printed sheet is conveyed through the inspection unit 5 and is cut in the cutting unit 6 to each predetermined unit length. Since printing is made on both surfaces of the cut sheet, no information is recorded in the information recording unit 7. The cut sheet is conveyed to the drying unit 8 one at a time and is then conveyed via the discharge conveying unit 10 and is sequentially discharged and stacked in the discharge unit 12 of the sorting unit 11. In this manner, in duplex printing mode, the sheet is processed while passing through the first path, second path, the first path and the third path in this order.

Figure 3:
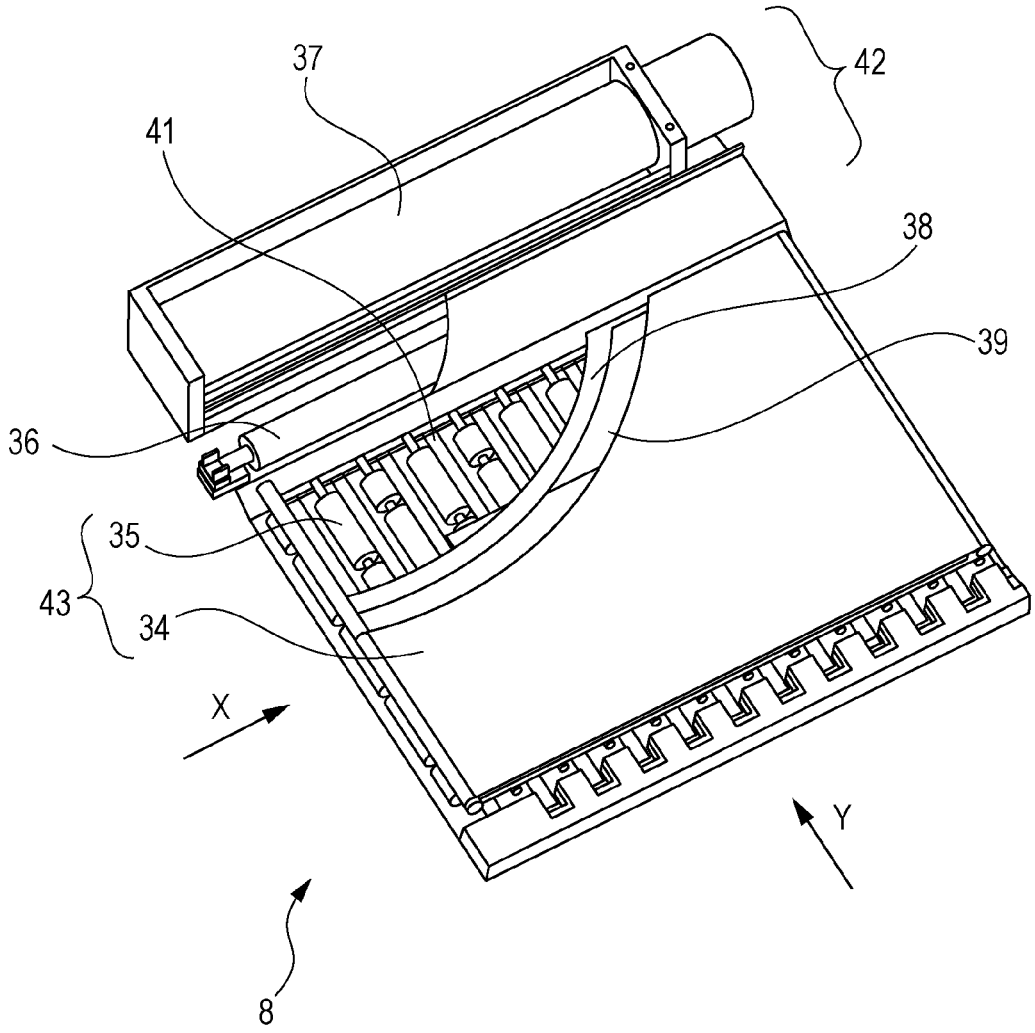
FIG. 3 is a perspective view of a drying unit.
Figure 4:
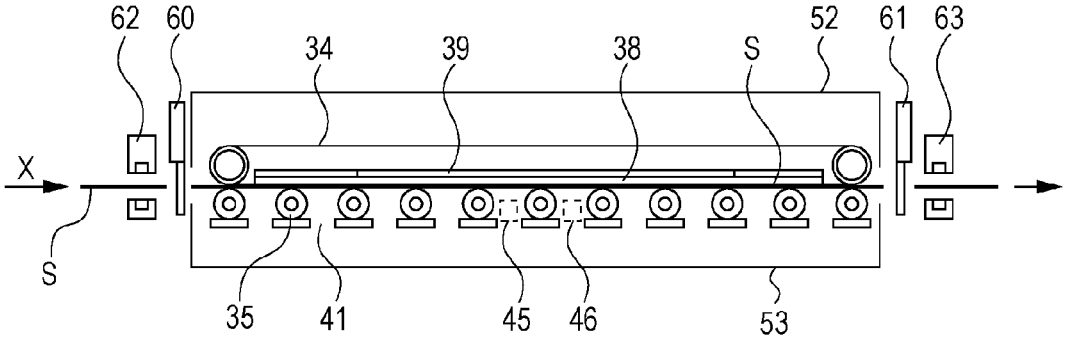
FIG. 4 is a sectional view of the drying unit.

Next, the drying unit 8 in the thus-configured printing apparatus will be described in more detail. FIG. 3 is a perspective view of an internal structure of the drying unit 8. FIG. 4 is a sectional view of the drying unit 8 seen from the direction of arrow Y in FIG. 3. The sheet on which ink is applied in the printing unit 4 is conveyed through the cutting unit 6 and the information recording unit 7 and is introduced into the drying unit 8 from a direction of arrow X in FIG. 3. The drying unit 8 includes a heating unit 42 and a conveying unit 43. The conveying unit 43 includes a conveying belt 34 and a plurality of conveying rollers (i.e., follower rollers) 35. The conveying belt is an endless belt which is driven to rotate. The conveying rollers 35 are arranged along a conveyance direction facing the conveying belt 34. A distance between adjacent conveying rollers 35 is shorter than the length of the smallest cut sheet. The sheet, either a continuous sheet or a cut sheet, introduced into the drying unit 8 smoothly advances in the drying unit 8 while being held by the conveying belt 34 and the conveying roller 35.

The heating unit 42 causes the hot air to circulate through the housing of the drying unit 8 and blows the hot air on the sheet. The heating unit 42 includes a heater 36 and a fan 37. The heater 36 raises the temperature of (i.e., heats) the air and produces the hot air. The fan 37 causes the hot air to circulate and blows the hot air on the sheet. The hot air sent by the fan 37 is moved upward through a plurality of slit-shaped ejection ports 41 provided in positions corresponding to the clearances between the conveying rollers 35 and is blown on the sheet surface. The hot air is then returned to the fan 37 and is made to circulate through the housing. A temperature sensor 45, such as a thermistor, for detecting temperature of the hot air is provided on an inner wall surface of the housing near the ejection ports 41. A hygrometer 46 (i.e., a humidity detector) for detecting humidity of the hot air is provided near the temperature sensor 45. The humidity detector for detecting humidity information is not limited to that which directly detects humidity using a hygrometer. For example, humidity may also be indirectly detected by detecting temperature using a temperature sensor or by estimating humidity with parameters such as ink depth and printing duty.

A heat transfer plate 38 and a surface heating element 39 are provided as an integrated structure inside the conveying belt 34. Heat generated in the surface heating element 39 is transferred to the heat transfer plate 38 which is a thermal conductor. As the conveying belt 34 is rotated, the inner surface of the conveying belt 34 slides in surface contact with a surface of the heat transfer plate 38. Since the conveying belt 34 and the heat transfer plate 38 are in contact with each other, heat is transferred from the heat transfer plate 38 to the conveying belt 34 and the temperature of the entire conveying belt 34 increases. When the sheet is conveyed inside the drying unit 8, the outer surface of the conveying belt 34 is in surface contact with the sheet and the sheet is heated. Thus, the sheet is dried in an accelerated manner. That is, the sheet is dried highly efficiently by being heated from both surfaces. In particular, the heater 42 blows the hot air on the front surface and the conveyer belt 34 heats the sheet on the back surface.

The heating unit 42 and the conveying unit 43 are accommodated in the housing of the drying unit 8 which consists of a first housing segment 52 (i.e., an upper cover) and a second housing segment 53 (i.e., a main part of the housing). The heating unit 42 and the conveying unit 43 (i.e., the conveying roller 35) are partially held by the second housing segment 53. As described later, the first housing segment 52 and the second housing segment 53 are hinged together and can be disengaged as an alligator mouth such that the operator might access the inside the drying unit 8 easily.

A first sheet sensor 62 for detecting existence of the sheet is provided near an inlet of the sheet in the drying unit 8 (i.e., the upstream side when seen from the drying unit 8). A second sheet sensor 63 for detecting existence of the sheet is provided near an outlet of the sheet in the drying unit 8 (i.e., the downstream side when seen from the drying unit 8). These sheet sensors function as a part of a jam detector which detects occurrence of a jam during the conveyance of the sheet in the drying unit 8. A sensor (i.e., a drawing detector) which detects that the drying unit 8 has been drawn from the main body of the printing apparatus is provided in the main body of the printing apparatus. The seventh cutter 23 and the eighth cutter 24 each include a sensor (i.e., a sheet cutting detector) which detects operations of cutting the sheet S by each of the cutters. With the sensor, the control unit can recognize that the operator has operated the cutter.

Here, circulation of the hot air inside the drying unit 8 will be described. FIG. 5 is a sectional view of the drying unit 8 seen from the direction of arrow X in FIG. 3. An opening 50 (i.e., a first opening) for introducing ambient air into the housing is provided at an upper surface of the second housing segment 53. The opening 50 includes a movable lid 55 which can adjust the opening amount of the opening 50. The lid 55 is opened or closed to adjust an amount of movement of the gas (i.e., efficiency in the introduction of the gas) through the opening 50 from outside the housing. An opening 51 (i.e., a second opening) for exhausting air from inside the housing is provided at a side surface of the second housing segment 53.

The opening 51 includes a movable lid 56 which can adjust the opening amount of the opening 51. The lid 56 is opened or closed to adjust an amount of movement of the gas (i.e., efficiency in the exhaustion of the gas) through the opening 51 from inside the housing. These lids 55 and 56 pivot open and close about a hinge when being driven by an actuator such as a solenoid or a motor controlled by the control unit. Instead of the pivotation about the hinge, the lids 55 and 56 may be slid laterally to open and close the openings 50 and 51.

As a variant example, the openings 50 and 51 may each include a fan which rotates at varying rotational state (i.e., with varying blowing capacity). The amount of movement of the gas can be adjusted by the rotational state of the fan. With active supply and exhaust ventilation using the fans provided in the openings, the air is ventilated in a shorter time. Although a functional separation is made between the introducing opening 50 and the exhausting opening 51 in this example, such a functional separation is not necessary: a single opening may alternatively be provided for both the introduction and exhaustion. Further alternatively, three or more openings may be provided.

Figure 5A:
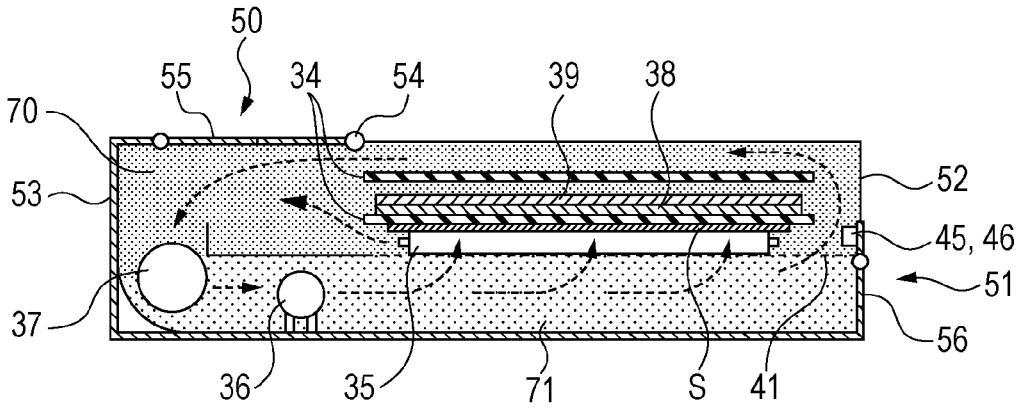
FIG. 5A is a sectional view of the drying unit.

FIG. 5A illustrates a state in which both the openings 50 and 51 are closed. In this state, the inside the housing of the drying unit 8 is substantially closed except for the inlet and outlet of the sheet. The fan 37 creates an air current, which is heated by the heater 36 to produce the hot air. The hot air is made to circulate through the closed space in the directions of arrows in FIG. 5A. The hot air is blown on the sheet through the clearances between a plurality of conveying rollers 35.

Figure 5B:
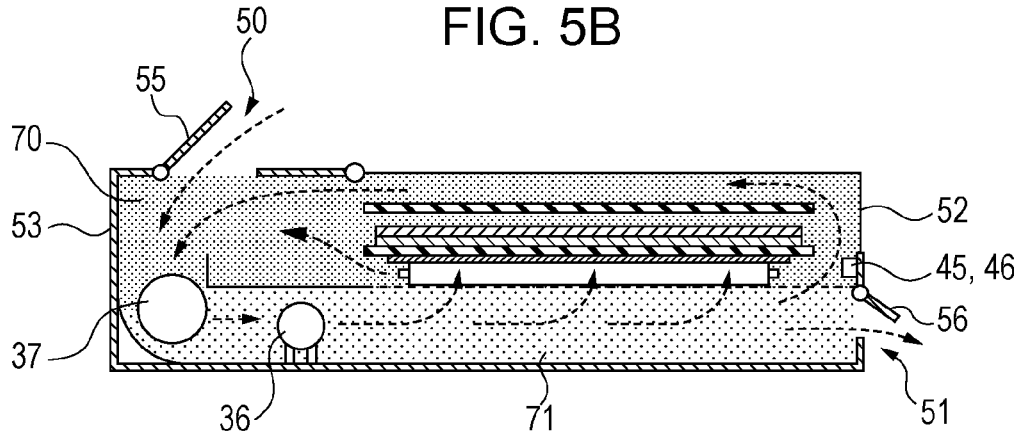
FIG. 5B is a sectional view of the drying unit.

FIG. 5B illustrates a state in which both the openings 50 and 51 are opened. The hot air circulates through the housing of the drying unit 8 in the directions of arrows in FIG. 5B. During the circulation, a part of the hot air is exhausted outside through the opening 51 and ambient air is introduced into the housing through the opening 50 in an amount equivalent to that of the exhausted air.

When an air current is created by the fan 37, an upstream side of the fan 37 is slightly negatively pressurized and a downstream side of the fan 37 is slightly positively pressurized along the direction of the air current. In FIGS. 5A and 5B, a dark gray region represents a negative pressure region 70 and a light gray regions represents a positive pressure region 71. The opening 50 is located as close to the fan 37 as possible in the negative pressure region 70 (i.e., a position with larger negative pressure) such that the ambient air might be naturally introduced by the negative pressure. The opening 51 is located in the positive pressure region 71 such that air inside the housing might be naturally exhausted by the positive pressure. The amount of air which passes through the openings 50 and 51 is set so as not to significantly disturb the air current of the hot air which circulates through the housing. The air inside the housing can be ventilated efficiently when the amount of air passing through the openings 50 and 51 and the amount of air of the circulating air are well-balanced.

If the temperature of the introduced ambient air is below the temperature of the air inside the drying unit 8, the temperature of the air inside the drying unit 8 will also decrease. Usually, since a relative temperature difference between the room temperature in which the printing apparatus is installed and the heated air in the drying unit 8 is large, the temperature of the air inside the drying unit 8 can be reduced rapidly. If the humidity of the introduced ambient air is below the humidity of the air inside the drying unit 8, the humidity of the air inside the drying unit 8 will also decrease. Usually, since a relative humidity difference between the humidity in the room in which the printing apparatus is installed and the inside the drying unit 8 is large, the humidity of the air inside the drying unit 8 can be reduced rapidly.

FIGS. 6A and 6B are sectional views of a main body of the printing apparatus, illustrating a section of the printing unit 4 and the drying unit 8. FIG. 6A illustrates a state in which the unit is accommodated inside the main body of the printing apparatus and the first housing segment 52 is closed. FIG. 6B illustrates a state in which the first housing segment 52 of the drying unit 8 is opened. A part of the drying unit 8 slides along a rail 57 provided in the main body of the printing apparatus and is drawn from the printing apparatus toward an operator. When the drying unit 8 is drawn as illustrated in FIG. 6B, the unit which includes the conveying unit 43 and the unit which includes the heating unit 42 are separated and the heating unit 42 remains in the main body of the printing apparatus.

Figure 7:
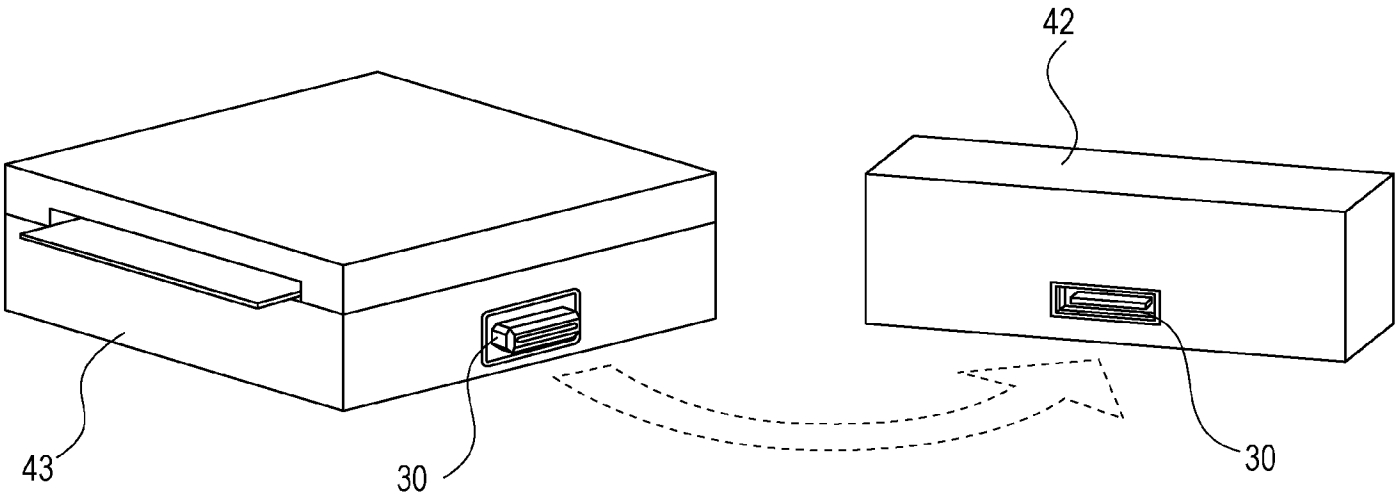
FIG. 7 illustrates a connection between units via a drawer connector.

As illustrated in FIG. 7, the heating unit 42 and the conveying unit 43 are electrically connected by a drawer connector 30. Power is supplied to the conveying unit 43 via the drawer connector 30. A signal wire for control is further connected via the drawer connector 30. When the drying unit 8 is mounted on the main body of the printing apparatus (i.e., the state of FIG. 6A), the drawer connector 30 is connected between the heating unit 42 and the conveying unit 43 and when the drying unit 8 is drawn from the main body of the printing apparatus (i.e., the state of FIG. 6B) the drawer connector 30 is disconnected. With this configuration, the high temperature heating unit 42 remains in the main body of the printing apparatus and is not exposed when the drying unit 8 is drawn, whereby the operator can easily and reliably perform a recovery operation.

When the drying unit 8 is drawn, the first housing segment 52 pivots about a distal hinge 54 as a rotation axis and the side of the operator opens as an alligator mouth. The opened first housing segment 52 keeps its open state by an urging mechanism (e.g., a gas spring, a hinge spring and a torsion spring). The first housing segment 52 holds an upper part of the conveyance mechanism of the drying unit 8 (i.e., the conveying belt 34, the heat transfer plate 38 and the surface heating element 39). The second housing segment 53 holds a lower part of the conveyance mechanism (i.e., the conveying roller 35). Thus, when the first housing segment 52 is opened, the conveyance mechanism is separated to expose the sheet S inserted between the conveying belt 34 and the conveying roller 35 whereby the operator can remove the sheet S easily.

Figure 8B:
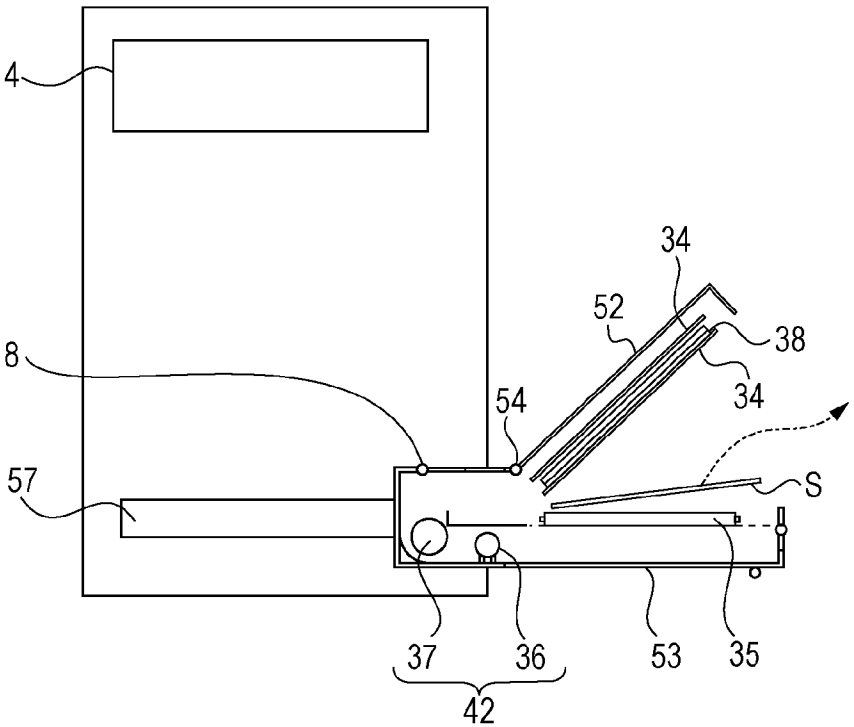
FIG. 8B illustrates a configuration of a variant example of FIG. 6B.
Figure 8A:
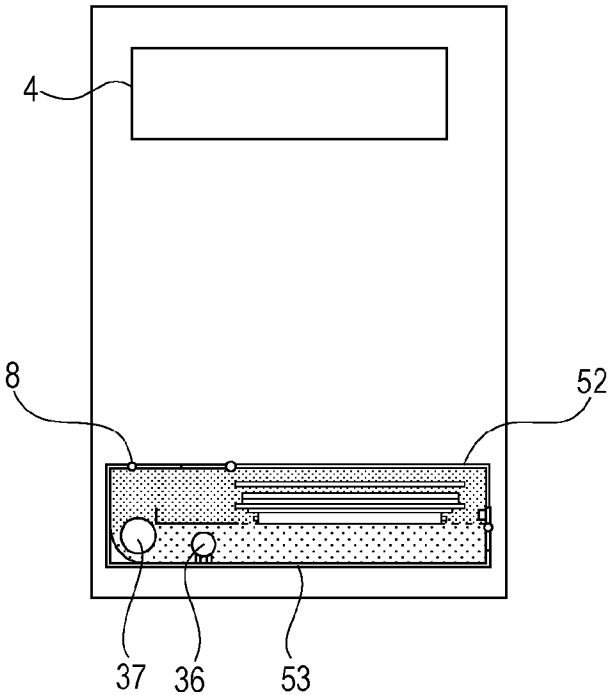
FIG. 8A illustrates a configuration of a variant example of FIG. 6A
Figure 9A:
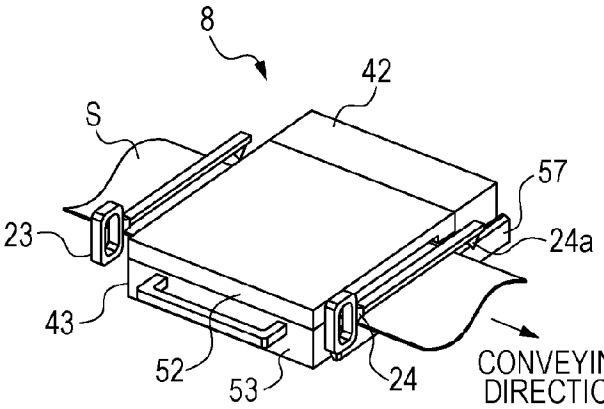
FIGS. 9A-9D illustrates a procedure of an unjamming operation.
Figure 9B:
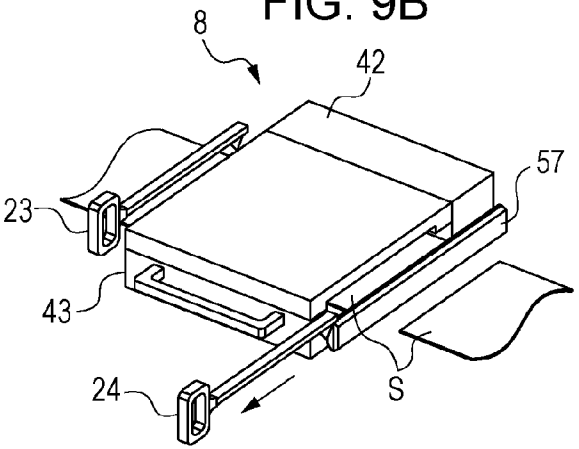
Figure 9C:
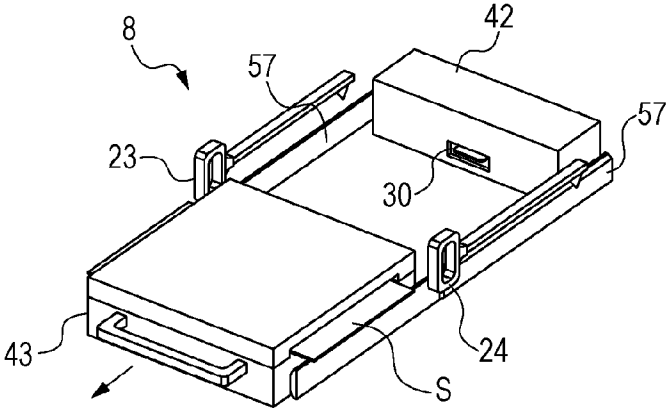
Figure 9D:
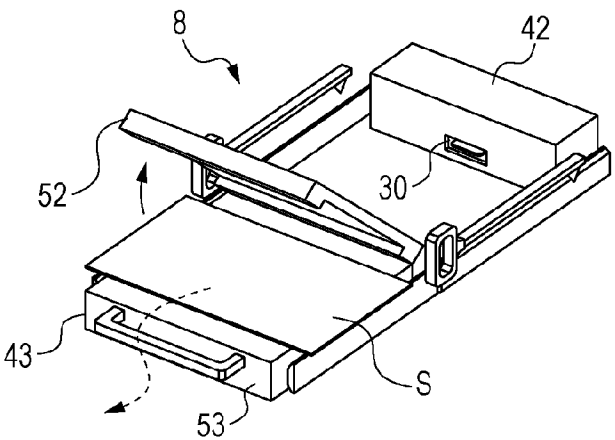

FIG. 8A illustrates a configuration of a variant example of FIG. 6A and FIG. 8B illustrates a configuration of a variant example of FIG. 6B. In these examples, when the drying unit 8 is drawn, the heating unit 42 and the conveying unit 43 are also drawn in an integrated manner. The second housing segment 53 also holds the heating unit 42 (i.e., the heater 36 and the fan 37), which is located further than the hinge 54 in the drawing direction. Even after the drying unit 8 is drawn to the maximum, most of the heating unit 42 remains in the housing of the main body of the printing apparatus. Also in this variant example, the high temperature heating unit 42 remains in the main body of the printing apparatus and is not exposed when the drying unit 8 is drawn, whereby the operator can perform a recovery operation easily and reliably.

Next, occurrence of a jam in the thus-configured printing apparatus and an accompanying unjamming operation will be described with reference to FIGS. 9A-9D. The printing apparatus includes a jam detector which detects occurrence of a jam during the printing operation and detects a location of the jam. The jam detector detects a jam by detecting an abnormality in the conveyance at a leading end of the sheet or in the middle of the sheet. In the former method, position information about the theoretical leading end of the sheet calculated based on the control information of the rollers is collated with detection results of the sheet sensor disposed between adjacent rollers. The jam detector determines a jam has occurred when the sheet sensor does not detect the leading end of the sheet during a period in which the leading end of the sheet is estimated to pass through, or when there is a significant delay in the detection of the leading end of the sheet with respect to the theoretical value. In the latter method, if a sheet conveyance failure occurs at a certain place while the continuous sheet is conveyed on a sheet conveyance path, the conveyance speed is reduced at the place and, in the worst case, the conveyance stops. When it happens, a subsequent sheet is continuously sent in that place and accumulated in a looped manner. The jam detector determines occurrence of a jam by detecting a decrease in a rotational state of a motor of the conveying rollers or detecting an abnormality in a motor load. As another method, a direct sensor which directly measures a movement state of a sheet surface (i.e., speed and displacement) may be provided at a plurality of positions along the sheet conveyance path and occurrence of a jam can be determined upon detection of an abnormality in the conveyance speed of the sheet. As further method, a size of a loop is measured by a sensor at a place at which a loop of a sheet is intentionally formed on the sheet conveyance path. If the measured size of the loop differs from a proper size, occurrence of a jam can be determined.

Upon detection of occurrence of a jam by the jam detector, the control unit stops the driving motors of all the conveying rollers related to the conveyance of the sheet in the sheet conveyance path. This is for the purpose of limiting the influence of the jam within the place in which the jam occurred and avoiding the influence from extending to the rest of the components. The control unit displays the jammed place and instructions on a display device of the manipulation unit 15 or the host device 16 to encourage the operator to manually perform the unjamming operation. In response to the instructions, the operator performs a manual unjamming operation by manually removing the jammed sheet left in a troubled place.

In the following description, an example will be described in which a jam occurs in a region including the drying unit 8 in the printing sequence for the first surface in the duplex printing mode. In the printing sequence for the first surface in the duplex printing mode, the continuous sheet passes through the drying unit 8 (see FIG. 9A). If a jam occurs in this process, the continuous sheet stops over the drying unit 8. When the operator tries to draw the drying unit 8 for the unjamming operation, the continuous sheet left in the sheet conveyance path hinders smooth drawing of the drying unit 8. When the operator tries to draw the drying unit 8 with excessive force, the continuous sheet may be drawn to damage the drying unit 8 and adjacent units, or the continuous sheet may be torn and pieces of the continuous sheet may remain in an irremovable manner. To address this problem, the operator cuts the continuous sheet at two places, i.e., the upstream and downstream of the continuous sheet, in the drying unit 8 using the seventh cutter 23 and the eighth cutter 24 which are disposed near the drying unit 8 before drawing the drying unit 8 (see FIG. 9B). The operator then draws the drying unit 8 from the main body of the printing apparatus along the rail 57. Since the sheet has been cut, the drying unit 8 can be drawn smoothly (see FIG. 9C). Then, the operator opens the first housing segment 52 of the drawn drying unit 8, removes a sheet piece remaining in the conveyance mechanism and removes the jam (see FIG. 9D). After the unjamming operation, the operator closes the first housing segment 52 and returns the drying unit 8 to the original position in the main body of the printing apparatus. After the maintenance door is closed, the jam detector detects the state of the jam again. If the jam detector still detects a jam, a warning is issued to encourage the operator to perform a manual unjamming operation again. Upon detection of no jam, the jam detector determines that the jammed sheet has been removed. Then, the maintenance mode is completed and the printing operation mode is resumed.

In the simplex printing mode or in the printing sequence for the second surface in the duplex printing mode, a sheet cut for each unit image in the cutting unit 6 is made to pass through the drying unit 8. If a jam occurs and the conveyance is stopped, the leading and trailing ends of the sheet left in the drying unit 8 are already cut. Thus, the operator can draw the drying unit 8 without the need of cutting the sheet using the hand cutter. That is, the sheet cutting operation illustrated in FIG. 9B can be omitted.

A method of controlling the thus-configured drying unit 8 will be described. Occurrence of a jam of a sheet being conveyed in the drying unit 8 is detected by the above-described jam detector. Upon occurrence of a jam, the control unit decreases the output of the heater 36 of the heating unit 42 (i.e., turns the heater 36 off). At the same time, the control unit increases the amount of movement of the gas through the opening by increasing the opening (at least one of the openings 50 and 51). Due to a synergistic effect of stopping the heating by the heater 36 and the ventilation with ambient air through the opening, the air temperature inside the drying unit 8 decreases quickly. Accordingly, when the conveyance of the sheet is stopped in the drying unit, the operator can start the unjamming operation quickly. Thus, maintenance workability is improved. When the conveyance of the sheet is stopped by reasons other than the jam, similar operations can be performed.

If the temperature detected by the temperature detector becomes lower than the predetermined value at the time of such a rapid decrease in temperature, the control unit controls the amount of movement of the gas through the opening to be decreased by switching the opening (at least one of the openings 50 and 51) from the opened state to the closed state. Such a configuration prevents an unnecessary decrease in the temperature in the drying unit 8 and thereby shortens the standup time after the unjamming operation is completed and the printing is resumed. From another point of view, energy consumption in the drying unit 8 is reduced.

As described above, when a printing apparatus is used for long time continuous printing or high-duty printing with heavy ink consumption, humidity in the air inside the drying unit 8 increases while efficiency in drying the sheet decreases. Even if the air temperature is kept constant, as the humidity increases, the ink becomes harder to evaporate when the hot air is blown on the sheet. As a result, the humidity as well as the temperature should be managed. When the humidity detected by the humidity detector (e.g., the hygrometer 46) exceeds a first predetermined value during the printing process (i.e., during the operation of the drying unit 8), the control unit controls the opening (at least one of the openings 50 and 51) to be switched to the opened state. The ventilation of the air through the opening prevents an excessive increase in the humidity in the air inside the drying unit 8. However, as the humidity decreases, the temperature also decreases and it is possible that an excessive decrease in the temperature might impair the sheet drying performance in the drying unit 8. To address this problem, when the detected humidity is below a second predetermined value (which is smaller than the first predetermined value), the control unit controls the opening (at least one of the openings 50 and 51) to be switched to the closed state. With these operations, the humidity and the temperature of the air inside the drying unit 8 can be kept in suitable ranges after a long time continuous printing.

The main body of the printing apparatus includes a locking mechanism for operator safety. In a locked state, the locking mechanism prevents drawing of the drying unit 8. Since the temperature inside the drying unit 8 becomes high during the printing operation, the drying unit 8 is locked such that the operator cannot draw the same at least during the printing operation (i.e., during operation of the drying unit 8.). Upon detection of a jam, the lock is released under predetermined conditions to allow the operator to draw the drying unit 8. In order to satisfy the predetermined conditions, all of the following conditions should be satisfied.

(1) The jam detector detects a jam during the printing operation on the first surface in the duplex printing mode.

(2) The internal temperature of the drying unit 8 detected by the temperature detector is lower than a predetermined temperature.

In addition to the above conditions (1) and (2), the following conditions may be added such that the lock is released only after it is confirmed that the continuous sheet has been cut at two places. In this manner, the operator safety is enhanced.

(3) Both the first sheet sensor 62 and the second sheet sensor 63 detect the sheet.

(4) The sheet cutting detector detects that the seventh cutter 23 and the eighth cutter 24 have been operated.

The locking mechanism may alternatively lock the first housing segment 52 and the second housing segment 53 from opening. In this case, in addition to the above conditions (1) and (2), an additional condition will be given that the drawing detector detects that the drying unit 8 has been drawn.

According to the embodiment described above, high drying efficiency can be kept even after a long time continuous operation and energy utilization efficiency is high. The printing apparatus of the present invention has an excellent maintenance workability. An operator can perform an unjamming operation promptly and properly when conveyance of a sheet is stopped due to, for example, a sheet jam in a drying unit. Even if the continuous sheet is stopped over a unit upon occurrence of a jam during the printing process, the continuous sheet can be cut with a cutter and the unit can be drawn reliably. With this configuration, the operator can perform the unjamming operation with less time and effort. Thus, maintenance workability is improved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-099148 filed Apr. 22, 2010, which is hereby incorporated by reference herein in its entirety.

What is claimed is:

1. An apparatus, comprising:

a printing unit configured to perform printing on a sheet using ink; and a drying unit configured to dry the sheet on which the ink is applied at the printing unit as the sheet is conveyed in the drying unit, wherein the drying unit causes hot air heated by a heater to circulate through a housing and blows the hot air to the sheet, wherein the housing includes an opening through which movement of gas between inside and outside the housing can be adjusted, wherein, when conveyance of the sheet in the drying unit stops, the apparatus is controlled to reduce an output of the heater and to increase the movement of the gas through the opening, and wherein the drying unit is configured to be drawn from a main body of the apparatus, and a first cutter, which cuts the sheet in an upstream side, and a second cutter, which cuts the sheet in a downstream side, are provided in a vicinity of the drying unit.

2. The apparatus according to claim 1, further comprising: a jam detector configured to detect occurrence of a jam of a sheet that is being conveyed, wherein, upon detection of occurrence of a jam by the jam detector, the apparatus is controlled to reduce the output of the heater and to increase an amount of the movement of the gas through the opening.

3. The apparatus according to claim 1, further comprising: a temperature detector configured to detect a temperature inside the housing, wherein, when the temperature detected by the temperature detector is below a predetermined value, the apparatus is controlled to reduce an amount of the movement of the gas through the opening.

4. The apparatus according to claim 1, further comprising: a humidity detector configured to detect humidity inside the housing, wherein, when the humidity detected by the humidity detector exceeds a predetermined value, the apparatus is controlled to increase an amount of the movement of the gas through the opening.

5. The apparatus according to claim 4, wherein, when the humidity detected by the humidity detector is below a predetermined value, the apparatus is controlled to reduce the amount of the movement of the gas through the opening.

6. The printing apparatus according to claim 1, further comprising: a fan positioned in the opening, wherein a rotation of the fan is variable and the movement of the gas is adjusted by the rotation of the fan.

7. The apparatus according to claim 1, further comprising: a movable lid in the opening, wherein the movement of the gas is adjusted by the movement of the movable lid.

8. The apparatus according to claim 1, wherein the opening includes a first opening for introducing air into the housing and a second opening for exhausting air from the housing, the first opening being formed in a negative pressure region of circulating hot air.

9. The apparatus according to claim 1, wherein the drying unit includes a heating unit and a conveying unit, wherein the heating unit includes a fan and the heater, wherein the conveying unit conveys the sheet, wherein the drying unit is configured to be drawn from a main body of the apparatus and, when the drying unit is drawn from the main body, the conveying unit is exposed from the main body of the apparatus and a part of the heating unit remains in the main body of the apparatus.

10. The apparatus according to claim 1, further comprising: a locking mechanism configured to lock the drying unit so that the drying unit is prevented from being drawn from the main body of the apparatus, wherein the locking mechanism is locked at least during a printing operation and is released upon detection of occurrence of a jam.

11. The apparatus according to claim 1, further comprising:

a sheet feeding unit configured to feed a continuous sheet;

a cutter unit configured to cut the sheet printed in the printing unit; and a reverse unit configured to reverse the sheet printed in the printing unit and to feed the reversed sheet to the printing unit, wherein, in duplex printing, the printing unit prints a plurality of images on a first side of the sheet fed from the sheet feeding unit, the sheet printed on the first surface passes through the drying unit and is led to the reverse unit, the reverse unit feeds the reversed sheet to the printing unit again, the printing unit prints a plurality of images on a second side that is a back of the first side of the sheet fed from the reverse unit, the cutter unit cuts the sheet printed on the second surface into a plurality of cut sheets, and the cut sheets pass through the drying unit and are ejected.

12. An apparatus, comprising:

a printing unit configured to perform printing on a sheet using ink; and a drying unit configured to dry the sheet on which the ink is applied at the printing unit as the sheet is conveyed in the drying unit, wherein the drying unit causes hot air to circulate through a housing and blows the hot air to the sheet, wherein the housing including an opening through which movement of gas between inside and outside the housing can be adjusted, and wherein the movement of the gas is adjusted in accordance with humidity inside the housing, and wherein the drying unit is configured to be drawn from a main body of the apparatus, and a first cutter, which cuts the sheet in an upstream side, and a second cutter, which cuts the sheet in a downstream side, are provided in a vicinity of the drying unit.

13. An apparatus, comprising:

a printing unit configured to perform printing on a sheet using ink; and a drying unit configured to dry the sheet on which the ink is applied at the printing unit as the sheet is conveyed in the drying unit, wherein the drying unit causes hot air heated by a heater to circulate through a housing and blows the hot air to the sheet, wherein the housing includes an opening through which movement of gas between inside and outside the housing can be adjusted, wherein the drying unit includes a heating unit and a conveying unit, wherein the heating unit includes a fan and the heater, wherein the conveying unit conveys the sheet, wherein the drying unit is configured to be drawn from a main body of the apparatus and, when the drying unit is drawn from the main body, the conveying unit is exposed from the main body of the apparatus and at least a part of the heating unit remains in the main body of the apparatus, and wherein, when conveyance of the sheet in the drying unit stops, the apparatus is controlled to reduce an output of the heater and to increase the movement of the gas through the opening.

14. The apparatus according to claim 13, further comprising: a locking mechanism configured to lock the drying unit so that the drying unit is prevented from being drawn from the main body of the apparatus, wherein the locking mechanism is locked at least during a printing operation and is released upon detection of occurrence of a jam.

* * * * *